US007292814B2

(12) United States Patent
Deguchi

(10) Patent No.: US 7,292,814 B2
(45) Date of Patent: Nov. 6, 2007

(54) PROCESS CARTRIDGE PREVENTING WINDING AND IMAGE FORMING APPARATUS

(75) Inventor: Hideaki Deguchi, Nagoya (JP)

(73) Assignee: Brother Kogyo Kabshiki Kaisha, Nagoya-shi, Aicki-ken (JP)

( * ) Notice: Subject to any disclaimer, the term of this patent is extended or adjusted under 35 U.S.C. 154(b) by 164 days.

(21) Appl. No.: 11/137,507

(22) Filed: May 26, 2005

(65) Prior Publication Data

US 2005/0265757 A1 Dec. 1, 2005

(30) Foreign Application Priority Data

May 26, 2004 (JP) ..... 2004-156546

(51) Int. Cl.
*G03G 15/16* (2006.01)

(52) U.S. Cl. ..... 399/316

(58) Field of Classification Search ..... 399/297, 399/310, 313, 316, 317, 388, 389
See application file for complete search history.

(56) References Cited

U.S. PATENT DOCUMENTS 6,512,904 B2 * 1/2003 Sato et al. ..... 399/111
2001/0016134 A1 8/2001 Park

FOREIGN PATENT DOCUMENTS

| | | |
|---|---|---|
| EP | 0 672 966 | 9/1995 |
| EP | 1 293 848 | 3/2003 |
| JP | 09114304 | 5/1997 |
| JP | 9281810 | 10/1997 |
| JP | 11212369 | 8/1999 |
| JP | 2001075391 | 3/2001 |
| JP | 2001222182 | 8/2001 |

* cited by examiner

*Primary Examiner*—Hoang Ngo
(74) *Attorney, Agent, or Firm*—Banner & Witcoff, Ltd

(57) ABSTRACT

A process cartridge includes (a) an image carrier for carrying a developer image; (b) a transfer roller for transferring the developer image onto a recording medium; (c) a winding preventer for preventing the recording medium from winding around the transfer roller; and (d) a cover which covers the transfer roller and which has an opposed surface opposed to the transfer roller. The winding preventer has a contact surface extending from the opposed surface toward the transfer roller, such that a leading edge of the recording medium is held in contact with the contact surface when the recording medium is pulled into between an outer circumferential surface of the transfer roller and the opposed surface of the cover. The opposed surface includes an immediately upstream portion which is immediately upstream of the contact surface as seen in a rotational direction of the transfer roller. An angle formed between the contact surface and the immediately upstream portion is acute. Also disclosed is a process cartridge that includes the winding preventer.

17 Claims, 8 Drawing Sheets

PROCESS CARTRIDGE PREVENTING WINDING AND IMAGE FORMING APPARATUS

INCORPORATION BY REFERENCE

The present application is based on Japanese Patent Application No. 2004-156546, filed on May 26, 2004, the content of which is incorporated herein by reference.

BACKGROUND OF THE INVENTION

1. Field of the Invention

The invention relates to an image forming apparatus such as a laser printer, and a process cartridge installed in the image forming apparatus.

2. Description of Related Art

An image forming apparatus such as a laser printer includes a combination of a photoconductive drum and a transfer roller which are adjacent to each other to form a pressure nip therebetween, and a combination of a heating roller and a pressing roller which are adjacent to each other to form a pressure nip therebetween and disposed on the downstream side of the combination of the photoconductive drum and transfer roller in a direction in which a recording medium in the form of a sheet of paper is fed along a sheet feeding path. The photoconductive drum carries a toner image formed according to image data. The toner image is transferred onto a paper sheet passing through the nip between the photoconductive drum and the transfer roller to which a transfer bias voltage is being applied. The paper sheet to which the toner image has been transferred is further passed through the nip between the heating roller and pressing roller, being heated by the heating roller and pressed between the heating and pressing rollers, thereby fixing the toner image on the paper sheet. In this way, a desired image is formed on the paper sheet.

In such a kind of image forming apparatus, the paper sheet may wind around any of various kinds of rollers in the image forming apparatus including the transfer roller, heating roller, and pressing roller.

In regard to the heating roller, which is disposed on the side of the sheet feeding path to be opposed to the surface of the paper sheet on which the toner image has been transferred, during the paper sheet with the toner image is passed through between the heating roller and pressing roller, the toner on the paper sheet contacts the heating roller and melts and adheres thereto, causing the paper sheet to wind around the heating roller.

There has been proposed, for instance in JP-A-2001-75391, to provide a separating claw which contacts an outer circumferential surface of a heating unit such as a heating roller to separate a paper sheet from the heating unit, in order to prevent the paper sheet from winding around the heating unit. When such a separating claw is provided, an edge of the paper sheet as being wound around the outer circumferential surface of the heating unit is brought into contact with the separating claw, prevented from further winding around the heating roller. The paper sheet is thus separated from the outer circumferential surface of the heating unit, enabling prevention of winding of the paper sheet around the heating unit.

However, the separating claw disclosed in the above-mentioned publication contacts the outer circumferential surface of the heating roller, and therefore is not suitably used for prevention of winding of a paper sheet around an elastic roller which may be a transfer roller, since when the separating claw contacts an elastic member formed of an elastic material, the separating claw damages the elastic member by cutting into the elastic member or otherwise.

SUMMARY OF THE INVENTION

It is therefore an object of the invention to provide a process cartridge and an image forming apparatus capable of preventing winding of a recording medium around an elastic roller without damaging the elastic roller.

To obtain the above object, the invention provides a process cartridge removably installed in an image forming apparatus, and comprising an image carrier, a transfer roller, and a winding preventer. The image carrier carries a developer image, the transfer roller is formed of an elastic material and disposed adjacent to the image carrier to form a pressure nip therebetween such that the developer image on the image carrier is transferred onto a recording medium as being passed through the nip, and the winding preventer is spaced from an outer circumferential surface of the transfer roller and prevents the recording medium from winding around the transfer roller.

By this arrangement, the winding preventer prevents the recording medium from winding around the transfer roller. Since the winding preventer is spaced from the outer circumferential surface of the transfer roller, the transfer roller is not damaged by contact of the winding preventer therewith. That is, according to the above arrangement, winding of the recording medium around the transfer roller is prevented, without damaging the transfer roller.

The invention also provides an image forming apparatus for forming an image on a recording medium, comprising an elastic roller made of an elastic material, a cover which covers at least a part of an outer circumferential surface of the elastic roller, and a winding preventer. The winding preventer is disposed on the cover such that the winding preventer is incapable of moving relatively to the cover and spaced from the outer circumferential surface of the elastic roller, so as to prevent the recording medium from winding around the elastic roller.

According to this image forming apparatus, winding of the recording medium around the elastic roller is prevented, without damaging the elastic roller.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIGS. 4A and 4B are side cross-sectional views of a mechanism supporting a transfer roller as shown in FIG. 1, in which FIG. 4A shows a state of the mechanism while the process cartridge is removed from a main body casing of the laser printer, and FIG. 4B shows a state of the mechanism while the process cartridge is installed on the main body casing;

DETAILED DESCRIPTION OF PREFERRED EMBODIMENTS

Figure 1:
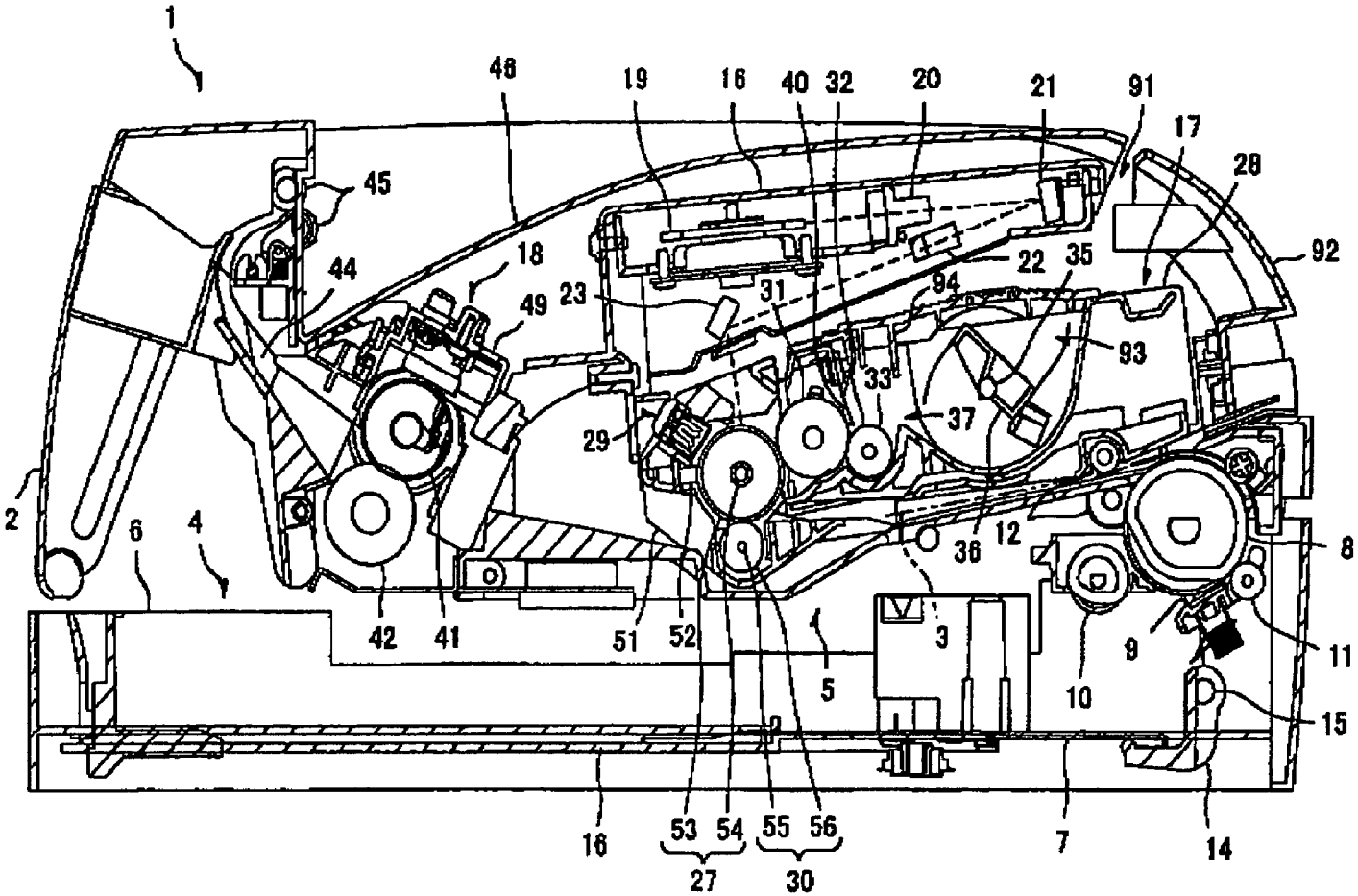
FIG. 1 is a side cross-sectional view of a laser printer as an image forming apparatus according to a first embodiment of the invention.

FIG. 1 is a side elevation cross-sectional view of an image forming apparatus in the form of a laser printer according to one embodiment of the present invention. As shown in FIG. 1, the laser printer, which is generally denoted by reference numeral 1, has a main body casing 2, which houses a feeder portion 4 arranged to feed a recording medium in the form of a sheet of paper 3, and an image forming portion 5 arranged to form an image on the sheet of paper 3.

In a side wall of the main body casing 2, an access opening 91, through which a process cartridge 17 (which will be described) is installed into and removed from the main body casing 1, is formed, and a front covering 92 for opening and closing the access opening 91 is pivotally attached. Namely, a support shaft is provided to pivotally support the front covering 92 at its lower end, so that the access opening 91 is closed by the front covering 92 placed at its closed position, and is opened when the front covering 92 is pivoted about the support shaft into its open position, to install or remove the process cartridge 17 into or from the main body casing 2. An operator's control panel having control keys and an LED indicator portion (including light emitting diodes) are provided in the front covering 92.

In the laser printer 1, the side of the front covering 92 will be referred to as "a front side" while the opposite side will be referred to as "a rear side".

The feeder portion 4 is housed in a bottom portion of the main body casing 2, and includes a removably installable sheet supply tray 6, a sheet supply roller 8 and a sheet supply pad 9 which are located above the front end portion of the sheet supply tray 6, a pickup roller 10 located on the rear side of the supply roller 8, a pinch roller 11 disposed adjacent to the sheet supply roller 8 on the lower front side of the sheet supply roller 8, and a pair of registering rollers 12 disposed on the upper rear side of the sheet supply roller 8.

In the sheet supply tray 6, there is disposed a paper presser plate 7 on which is placed a stack of paper sheets 3. The paper presser plate 7 is pivotally supported at its rear end so that its front end is vertically displaceable.

A lever 14 is disposed at a front end of the sheet supply tray 6, to lift a front end of the paper presser plate 7. More specifically, the lever 14 is generally L-shaped in cross section to extend from the front side of the paper presser plate 7 to its under side. An upper end of the lever 14 is attached to a lever shaft 15 while a rear end of the lever 14 is held in contact with an under side of the front end of the paper presser plate 7. When the lever shaft 15 is driven or rotated in the clockwise direction as seen in FIG. 1, the lever 14 is pivoted around the lever shaft 15, so that the rear end of the lever 14 lifts the front end of the paper presser plate 7.

When the front end of the paper presser plate 7 is thus lifted, the topmost one of the paper sheets 3 stacked on the sheet supply tray 6 is pressed or held down by the pickup roller 10, and starts to be fed toward between the sheet supply roller 8 and sheet supply pad 9.

When the sheet supply tray 6 is removed from the main body casing 2, the front end of the paper presser plate 7 lowers by its own weight, so that the paper presser plate 7 becomes parallel to a bottom surface of the sheet supply tray 6. In this state, the paper sheets 3 can be stacked on the paper presser plate 7.

The paper sheets 3 are fed out one by one with reliability by the pickup roller 10 toward between the sheet supply roller 8 and the sheet supply pad 9, since each paper sheet 3 is separated from the following one or ones when nipped between the sheet supply roller 8 and sheet supply pad 9 by rotation of the sheet supply roller 8. The paper sheet 3 is then passed to the registering rollers 12, via a nip between the sheet supply roller 8 and the pinch roller 11.

The registering rollers 12 are a pair of rollers adjacent to each other, and configured to register the paper sheet 3 passed through a nip therebetween, such that the leading edge of the paper sheet 3 is parallel to the axes of the registering rollers 12, so that the paper sheet 3 is registered at an image forming position at which a toner image is transferred from an image carrier in the form of a photoconductive drum 27 onto the paper sheet 3. In the present embodiment, the image forming position is defined by a pressure nip between the photoconductive drum 27 and a transfer roller 30.

The image forming portion 5 includes a scanner portion 16, the previously indicated process cartridge 17, and an image fixing portion. The scanner portion 16 is disposed in an upper portion of the main body casing 2, and includes a laser source (not shown), a rotary polygon mirror 19, an fθ lens 20, a first reflective mirror 21, a lens 22, and a second reflective mirror 23. A laser beam which is generated from the laser source is modulated according to image data representative of an image to be formed on the paper sheet 3, as well known in the art. The thus modulated laser beam is directed to the outer circumferential surface of the photoconductive drum 27, along an optical path indicated by a broken line in FIG. 1. Namely, the laser beam is deflected by the polygon mirror 19 to be passed through the fθ lens 20, and then reflected by the first reflective mirror 21. The reflected laser beam is passed through the lens 22 and bent downward by the second reflective mirror 23 to irradiate the outer circumferential surface of the photoconductive drum 27 (which will be described later). In this way, the surface of the photoconductive drum 27 is irradiated by the modulated laser beam with a high scanning operation of the scanner portion 16.

Figure 2:
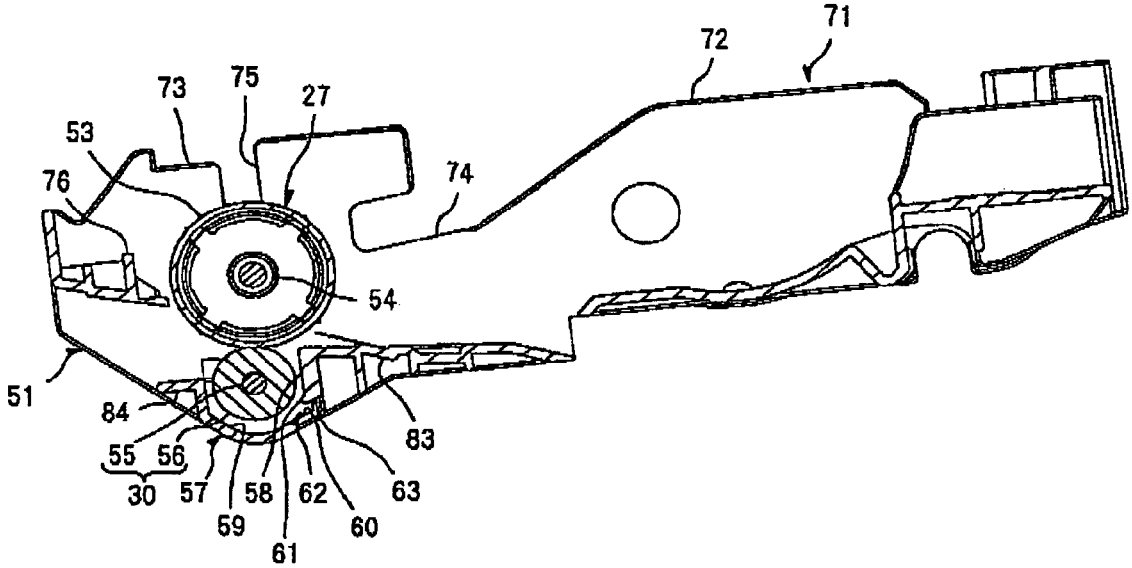
FIG. 2 is a cross-sectional view of a relevant portion of a process cartridge as shown in FIG. 1.

The process cartridge 17 is removably installed in a portion of the main body casing 2, which is located below the scanner portion 16. As shown in FIGS. 1 and 2, the process cartridge 17 includes a housing structure 51, the above-indicated photoconductive drum 27 accommodated in the housing structure 51 and functioning as a toner image carrier, a developing cartridge 28, a Scorotron type charger 29, the transfer roller 30 as an elastic roller formed of an elastic foamed material, and an electrically conductive brush 52.

The photoconductive drum 27 takes the form of a cylinder, and includes a cylindrical drum body 53, and a drum shaft 54 which is made of a metallic material and coaxial with the drum body 53, extending in the axial direction of the drum body 53. The drum body 53 has a positively chargeable photosensitive layer including an outermost layer which is formed of polycarbonate, for example. The drum shaft 54 is supported by the housing structure 51 (more specifically, by a drum accommodating portion 73 of an upper cover structure 71 as described below) such that the drum shaft 54 is not rotatable relative to the housing structure 51 or 71, while the drum body 53 is rotatably supported by the drum shaft 54. Thus, the photoconductive drum 27 is accommodated in the housing structure 51 or the drum accommodating portion 73 of the upper cover structure 71 described below, such that the drum body 53 is rotatable about the drum shaft 54.

The developing cartridge 28 is removably accommodated in the housing structure 51, and includes a toner chamber 93, a developing roller 31, a toner-layer thickness regulator blade 32, and a toner supply roller 33.

The toner chamber 93 is defined in a front portion of a space inside the developing cartridge 28, and separated by a partition plate 94 from a rear portion of the space inside the developing cartridge 28. The toner chamber 93 accommodates a developing agent in the form of a positively chargeable non-magnetic one-component toner, which is preferably a polymerized toner produced by copolymerizing, in a known polymerizing method such as suspension polymerization, polymerized monomers, for example, styrene monomers such as styrene, and acrylic monomers such as acrylic acid, alkyl(C1-C4)acrylate and alkyl(C1-C4)methacrylate. The polymerized toner, which is a powder of spherical particles, has an extremely high degree of fluidity and permits formation of a high-quality image.

The toner may contain a coloring agent such as carbon black, and a wax, and may contain an additive such as silica for improving the fluidity. The particle size of the toner is preferably within a range of about 6-10 μm. The toner within the toner chamber 93 is agitated by an agitator 36 supported by a drive shaft 35 which is located in a central portion of the toner chamber 93. The thus agitated toner is delivered through an opening 37 formed through a lower portion of the partition plate 94 and permitting communication between the front and rear portions of the space inside the developing cartridge 28 which are separated by the partition plate 94.

A toner supply roller 33 is located on the rear side of the opening 37, and is rotatably supported by the developing cartridge 28. The toner supply roller 33 includes a metallic roller shaft and a roller portion which is formed of an electrically conductive foamed material and which covers the roller shaft.

The developing roller 31 is rotatably supported by the developing cartridge 28, on the rear side of the toner supply roller 33 to be held in a pressing rolling contact with the toner supply roller 33. A part of the developing roller 31 on the side opposite to the toner supply roller 33 is rearward exposed to the outside of the developing cartridge 28. The developing roller 31 is adjacent to the photoconductive drum 27 in the front-rear direction to be in rolling contact therewith while the developing cartridge 28 is mounted on the housing structure 51. The developing roller 31 includes a metallic roller shaft and a roller portion which is formed of an electrically conductive rubber material and which covers the roller shaft. The roller portion of the developing roller 31 has a roller layer formed of an electrically conductive urethane or silicone rubber which contains fine particles of carbon and which is covered by a coating layer formed of an urethane or silicone rubber containing fluorine.

The toner-layer thickness regulator blade 32 includes a blade body in the form of a metallic sheet spring, and a presser 40 fixed at a distal end portion of the sheet spring. The presser 40 has a semi-circular shape in cross section and is formed of an electrically insulating silicone rubber. The toner-layer thickness regulator blade 32 is supported at its proximal end by the developing cartridge 28, at a position right above the developing roller 31, such that the presser 40 is held in pressing contact with the developing roller 31 under a biasing force of the blade body.

A portion of the toner delivered through the opening 37 is transferred onto the developing roller 31 by a rotary motion of the toner supply roller 33, and is positively friction-charged between the toner supply roller 33 and the developing roller 31. The toner lying on the outer circumferential surface of the developing roller 31 is introduced into a pressure nip between the presser 40 of the toner-layer thickness regulator blade 32 and the developing roller 31, so that the outer circumferential surface of the developing roller 31 is covered by a relatively thin toner layer having a predetermined thickness.

The Scorotron type charger 29 is supported by the housing structure 51 such that the charger 29 is located on the upper rear side of the photoconductive drum 27 in a spaced-apart relationship with the drum 27. This charger 29 is of a positive charging type having a charging wire formed of tungsten, for example, which is capable of effecting a corona discharge for evenly and positively charging the outer circumferential surface of the photoconductive drum 27.

As described below in detail, the toner transfer roller 30 is rotatably supported by the housing structure 51, such that the transfer roller 30 is displaceable in a vertical direction in which the transfer roller 30 and the photoconductive drum 27 is aligned while the process cartridge 17 is removed from the main body casing 2. This toner transfer roller 30 includes a metallic roller shaft 55, and a roller portion 56 which is formed of a rubber material as an electrically conductive elastic material on the roller shaft 55, so as to cover the roller shaft 55. The transfer roller 30 forms a nip between the roller portion 56 thereof and the photoconductive drum 27 such that the toner transfer roller 30 is located below and held in rolling contact with the photoconductive drum 27, so as to form a pressure nip therebetween. To transfer the toner image from the photoconductive drum 27 onto the paper sheet 3, a transfer bias voltage is applied to the toner transfer roller 30.

The electrically conductive brush 52 is located on the side of the photoconductive drum 27 (which is remote from the developing roller 31), and is supported by the housing structure 51 such that the distal end of the brush 52 is held in contact with the outer circumferential surface of the photoconductive drum 27.

Figure 3:
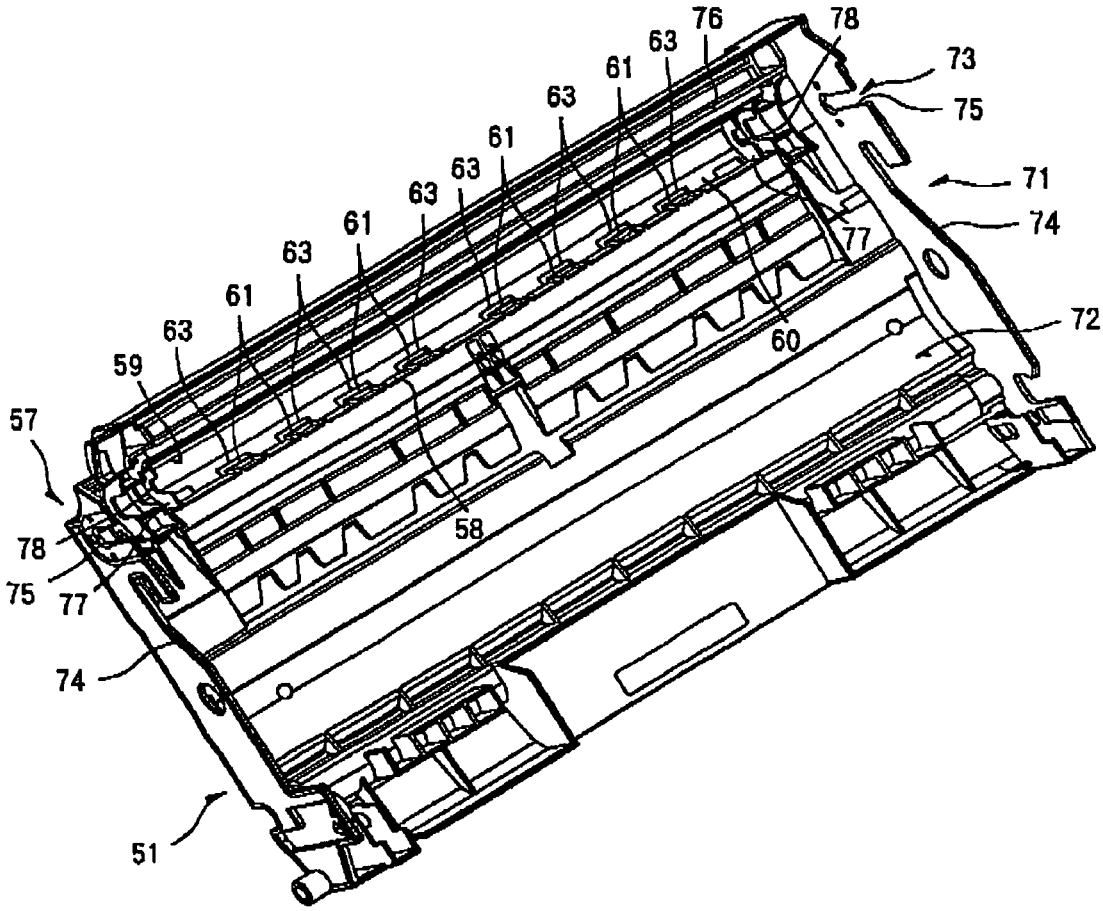
FIG. 3 is a perspective view of the process cartridge of FIG. 2.

The housing structure 51 comprises the upper cover structure 71, and a lower cover structure 57 constituting a cover, as shown in FIGS. 2 and 3.

The upper cover structure 71 comprises the cartridge accommodating portion 72 at its front portion, and the drum accommodating portion 73 at its rear portion. The drum accommodating portion 73 is for accommodating the photoconductive drum 27 and the scorotron-type charger 29.

A pair of guide grooves 74 for guiding the roller shaft of the developing roller 31 are formed in opposite side walls of the cartridge accommodating portion 72. The developing cartridge 28 is installed into and removed from the cartridge accommodating portion 72 with the roller shaft of the developing roller 31 guided along the guiding grooves 74.

A pair of mounting grooves 75 are formed in opposite side walls of the drum accommodating portion 73 to vertically extend, and a brush mounting portion 76 is disposed on the rear side of the mounting grooves 75 to extend along the axial direction of the photoconductive drum 27. The photoconductive drum 27 is supported at the drum accommodating portion 73 of the upper cover structure 71 with opposite ends of the drum shaft 54 inserted in the mounting grooves 75 to be brought into contact with the bottom of the mounting grooves 75, in which position the drum shaft 54 is fixed to be incapable of rotation relatively to the upper cover structure 71. The conductive brush 52 is fixed to the brush mounting portion 76 with an end of the conductive brush 52 in contact with the outer circumferential surface photoconductive drum 27.

While the process cartridge 17 is installed in the main body casing 2, the lower cover structure 57 is disposed on the side of the transfer roller 30 with respect to a sheet feeding path, along which the paper sheet 3 is transported, in the direction in which the drum 27 and the transfer roller 30 are opposed to each other, to cover a part of an outer circumferential surface of the transfer roller 30 or its roller portion 56. The front end of the lower cover structure 57 is disposed upstream of the nip or opposing position between the drum 27 and the transfer roller 30 in the direction in which the paper sheet 3 is fed (which direction will be hereinafter referred to as "a sheet feeding direction"), while a rear end of the lower cover structure 57 is disposed downstream of the nip between the drum 27 and the transfer roller 30 in the sheet feeding direction. The lower cover structure 57 is formed continuously throughout its length in the front-rear direction, to have a U-like shape in cross section so as to protect the outer circumferential surface of the transfer roller 30 against the outside space opposite to the photoconductive drum 27. By thus forming the lower cover structure 57, the transfer roller can be protected by the lower cover structure 57 against the outside opposite to the photoconductive drum 27 with respect to the sheet feeding path, while a plurality of retaining portions 62 as a winding preventer (described fully later) formed in the lower cover structure 57. This arrangement prevents winding of the paper sheet 3 entering between the transfer roller and the lower cover structure 57 around the transfer roller 30, which will be described in detail below.

The lower cover structure 57 has a surface opposed to the transfer roller 30, which opposed surface comprises a substantially vertical flat part (hereinafter simply referred to as a vertical part) 58, a circular part 59, and a flat connecting part 60. The vertical part 58 extends downward in a substantially vertical direction from a front end of the opposed surface on the upstream side in the sheet feeding direction. The circular part 59 has an arc-like shape in cross section, and extends substantially along the outer circumferential surface of the roller portion 56 of the transfer roller 30, from a rear end of the opposed surface on the downstream side in the sheet feeding direction to the under side of the roller portion 56. The flat connecting part 60 connects the vertical part 58 and the circular part 59.

A support plate 77 for supporting the roller shaft 55 of the transfer roller 30 is formed at each of the positions in the lower cover structure 57 corresponding to the axial opposite ends of the transfer roller 30, as shown in FIG. 3. Each support plate 77 is disposed to extend along the vertical direction and continuously from the vertical part 58, circular part 59, and connecting part 60.

Each of the support plates 77 has a support groove 78 U-shaped and open on its upper side when the support plates 77 are seen from a lateral side.

An insertion hole (not shown) is formed through the connecting part 60 at a position corresponding to each of the axial opposite ends of the transfer roller 30 and in the vicinity of the support plate 77.

Figure 4A:
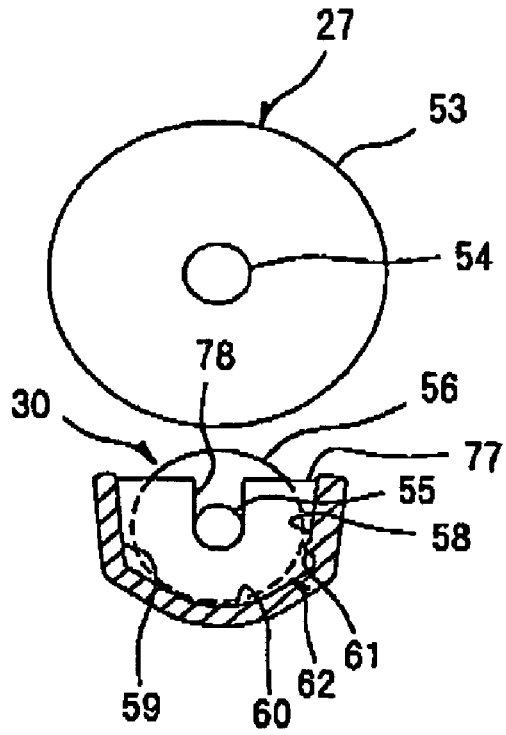
Figure 4B:
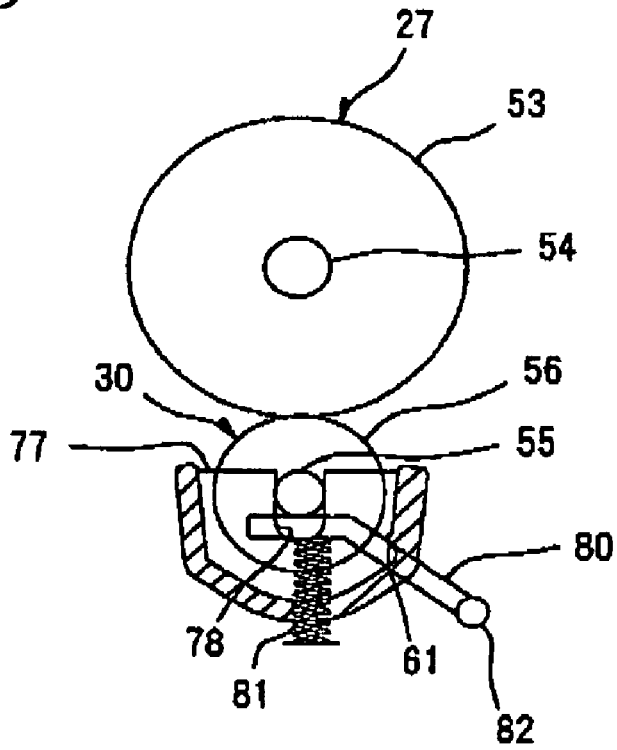

On the other hand, in the main body casing 2, a pair of biasing levers 80 and a pair of springs 81 are disposed. When the process cartridge 17 is installed in the main body casing 2, each of the biasing levers 80 is inserted through one of the insertion holes, and each of the springs 81 biases a corresponding one of the biasing levers 80 toward the roller shaft 55 of the transfer roller 30, as shown in FIG. 4B.

A front end of each of the biasing levers 80 is supported rotatably around a rotation axis 82 in the main body casing 2, while a rear part thereof is disposed to be contactable with the roller shaft 55 from the under side.

Each of the springs 81 is a compression spring and biases the rear part of the biasing lever 80 upward. The rear part of each biasing lever 80 receiving a biasing force of the spring 81 is disposed along the direction of mounting of the process cartridge 17 or a horizontal direction.

The opposite ends of the roller shaft 55 of the transfer roller 30 are supported at the support grooves 78 of the supporting plates 77, to be movable in a vertical direction and rotatable. While the process cartridge 17 is removed from the main body casing 2, the opposite ends of the roller shaft 55 are brought into contact with the bottoms of the support grooves 78 by its own weight, and rotatably supported there, with the roller portion 56 of the transfer roller 30 and the drum body 53 of the photoconductive drum 27 spaced from each other in their opposing direction, as shown in FIG. 4A. By this arrangement, it is prevented that the photoconductive drum 27 is damaged due to its contact with the transfer roller 30 while the process cartridge 17 is removed from the main body casing 2.

As shown in FIG. 4B, while the process cartridge 17 is installed in the main body casing 2, the biasing levers 80 contact the opposite ends of the roller shaft 55 of the transfer roller 30 from the under side to bias the roller shaft 55 upward. Hence, the opposite ends of the roller shaft 55 are elevated to a midway point in the support grooves 78, bringing the roller portion 56 of the transfer roller 30 into pressing contact with the drum body 53 of the photoconductive drum 27. A pressure nip between the photoconductive drum 27 and the transfer roller 30 is thus reliably formed, enabling to reliably transferring the toner image onto the paper sheet 3.

At the lower end of the vertical part 58, there are formed a plurality of contact portions 61 which protrude toward the transfer roller 30 and are spaced from one another in the axial direction of the transfer roller 30, as shown in FIG. 3.

Each contact portion 61 protrudes by such an amount that an end of the contact portion 61 does not contact the transfer roller 30 and is spaced in the front-rear direction from the transfer roller 30 while the process cartridge 17 is installed in the main body casing 2 as shown in FIG. 4B, and the end of the contact portion 61 does not contact the transfer roller 30 even while the process cartridge 17 is removed from the main body casing 2 with opposite ends of the roller shaft 55 of the transfer roller 30 in contact with the bottoms of the support grooves 78 of the support plates 77 by its own weight, as shown in FIG. 4A. Thus, each contact portion 61 rearward and downward protrudes by the amount described above from the lower end of the vertical part 58.

Figure 8A:
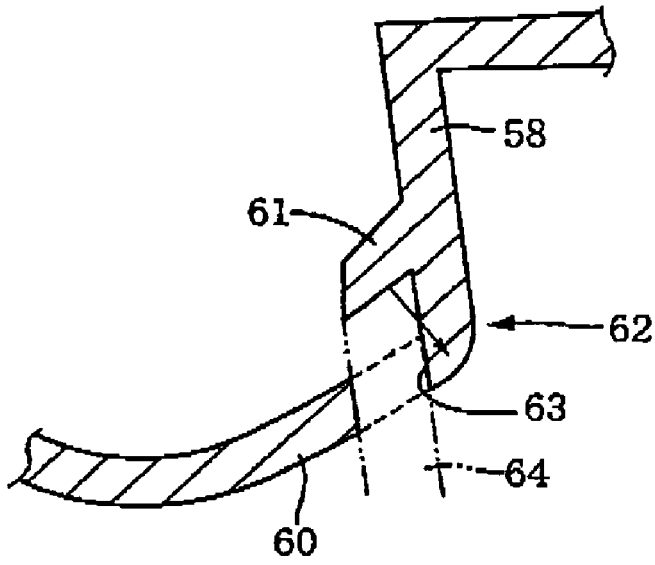
FIG. 8A is a cross-sectional view of a retaining portion and its vicinity, including an opening necessary for forming a contact portion, in the laser printer according to the first embodiment.

The contact portions 61 are formed integrally with the housing structure 51 including the lower cover structure 57, by injecting a resin material into a mold. In the connecting part 60, there are formed a plurality of openings 63 at respective positions to pull out therethrough movable insert dies or slide cores 64, which are used to form undercuts adjacent to the respective contact portions in the lower cover structure 57, away from the contact portions 61, after the molding. Thus, in forming the lower cover structure 57, the movable insert die or slide core 64 can be smoothly separated from the contact portions 61. Hence, the contact portions 61 can be formed integrally with the housing structure 51 with ease, simplifying the structure of the process cartridge 17. It is noted that although in the present embodiment the movable insert dies or slide cores 64 are used to form the undercuts adjacent to the respective contact portions, where the draft of a cavity of the mold is not provided or very small as shown in FIG. 8A, the stationary dies may be employed instead of the movable insert dies or slide cores 64.

The contact portions 61 are opposed to and spaced from the connecting part 60 in a vertical direction. Each contact portion 61 has a surface with which a leading edge of an incoming paper sheet 3 is brought into contact, as described later. The surface which the leading edge contacts is opposed to the vertical part 58, as indicated by an arrow in FIG. 8A, such that the surface forms an acute angle with the vertical part 58. Thus, there are formed the retaining portions 62 (shown in FIGS. 4 and 6) each having a claw-like shape in cross section. More specifically, each of the retaining portions 62 includes one of the contact portions, a part of the vertical part 58, and a part of the connecting part 60. The retaining portions 62 respectively define inside thereof retention spaces.

The leading edge of the paper sheet 3 entering between the circular part 59 and transfer roller 30 is brought into contact with the contact portions 61, and this state is maintained. The retaining portions 62 and retention spaces hold the paper sheet 3 in the state where its leading edge is in contact with the contact portions 61, on the upstream side of the contact portions 61 in the direction of rotation of the transfer roller 30.

As shown in FIG. 2, at the front end of the lower cover structure 57, there is disposed along the sheet feeding path a feed-in chute 83 which guides the paper sheet 3 to the nip between the photoconductive drum 27 and the transfer roll 30 before transferring of the toner image. At the rear end of the lower cover structure 57, a feed-out chute 84 for guiding the paper sheet 3 from the nip between the photoconductive drum 27 and transfer roller 30 is disposed along the sheet feeding path.

Referring back to FIG. 1, the outer circumferential surface of the photoconductive drum 27 is first evenly positively charged by the charger 29, and is then exposed to the modulated laser beam generated from the scanner portion 16, to form a latent image according to the image data.

Subsequently, the toner carried and positively charged by the developing roller 31 is brought into contact with the photoconductive drum 27, by a rotary motion of the developing roller 31, so that the electrostatic latent image is developed into a visible toner image. Namely, the toner is transferred to local portions of the evenly positively charged outer circumferential surface of the photoconductive drum 27, which local portions have been exposed to the laser beam and have reduced potential values.

While the paper sheet 3 is fed through the pressure nip between the photoconductive drum 27 and the toner transfer roller 30, with rotary motions of the drum 27 and roller 30, the toner image on the photoconductive drum 27 is transferred therefrom onto the paper sheet 3. Paper dust adhering to the outer circumferential surface of the photoconductive drum 27 as a result of its contact with the paper sheet 3 for transferring the toner image onto the paper sheet 3 is brought into contact with the electrically conductive brush 52 with a further rotary motion of the drum 27, so that the paper dust is removed by the brush 52.

The image fixing portion 18 is disposed on the rear side of the process cartridge 17, and includes a frame, and a heating roller 41 and a presser roller 42 which are housed in the frame.

The heating roller 41 comprises a metallic cylinder and a halogen lamp as a heat lamp disposed in the cylinder. The heating roller 41 is rotated by a motor not shown.

The presser roller 42 is disposed below and in pressing contact with the heating roller 41. The presser roller 42 is formed by covering a metallic roller shaft with a roller of rubber material, and driven by the rotation of the heating roller 41.

At the fixing portion 18, the toner or toner image transferred onto the paper sheet 3 is heat fused while the paper sheet 3 passes through the nip between the heating roller 41 and presser roller 42. The paper sheet 3 on which the toner has been fixed is fed to a paper ejection path 44 vertically extending toward the upper surface of the main body casing 2. The paper sheet 3 fed into this ejection path 44 is then ejected onto a catch tray 46 formed on the upper surface of the main body casing 2 by means of a pair of ejection rollers 45 disposed above the ejection path 44.

In the present laser printer 1, the paper sheet 3 is prevented from winding around the transfer roller 30 by the provision of the retaining portions 62, each including the contact portion 61, and defining inside thereof the retention space.

Figure 5A:
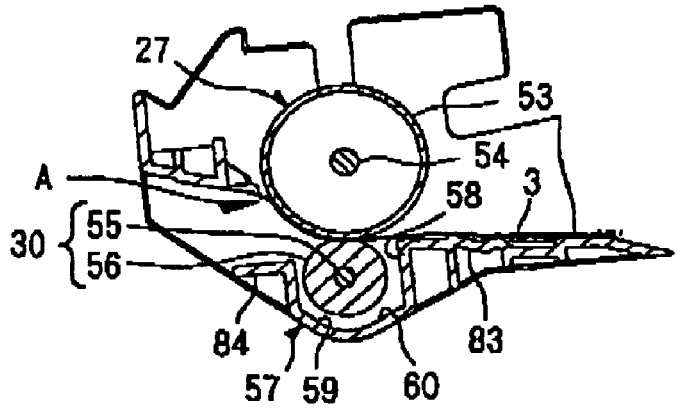
FIGS. 5A-5D illustrate how a paper sheet winds around the transfer roller shown in FIG. 1.
Figure 5B:
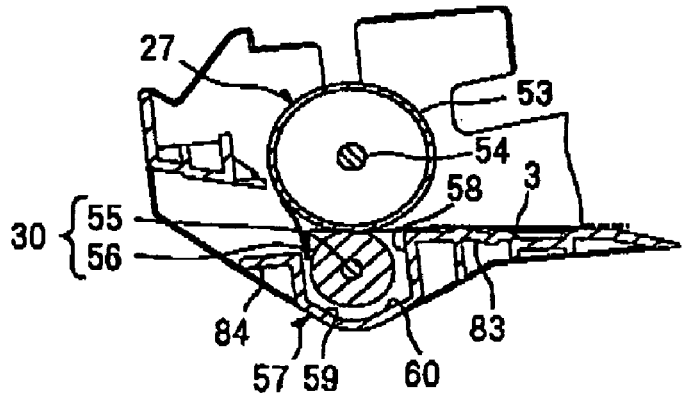
Figure 5C:
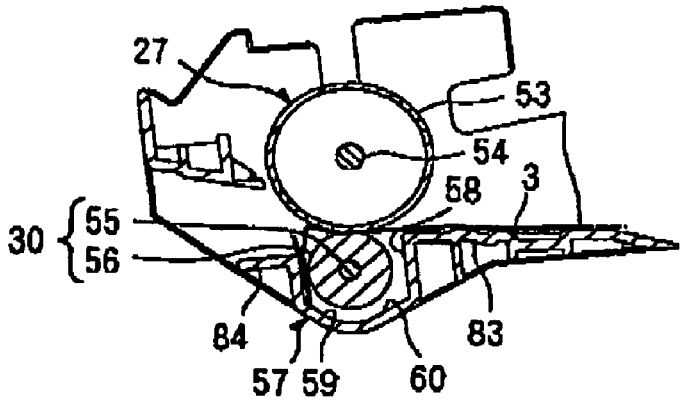
Figure 5D:
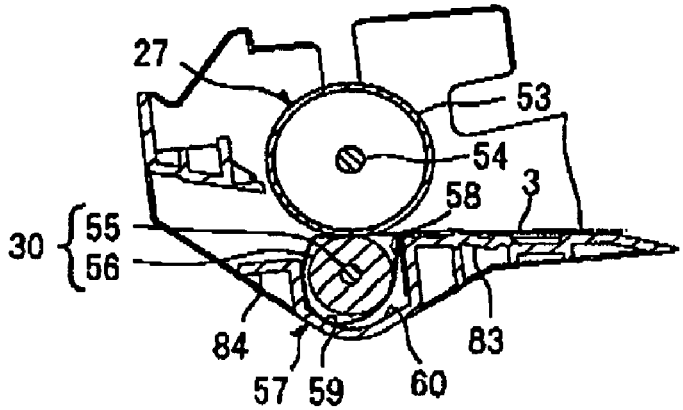
Figure 6A:
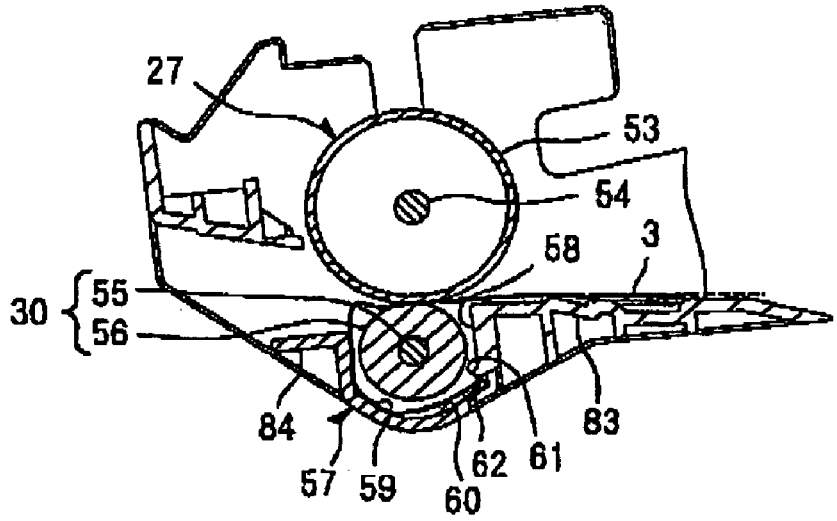
FIGS. 6A and 6B illustrate how a retaining portion and a retention space shown in FIG. 2 prevent a paper sheet from winding around the transfer roller.
Figure 6B:
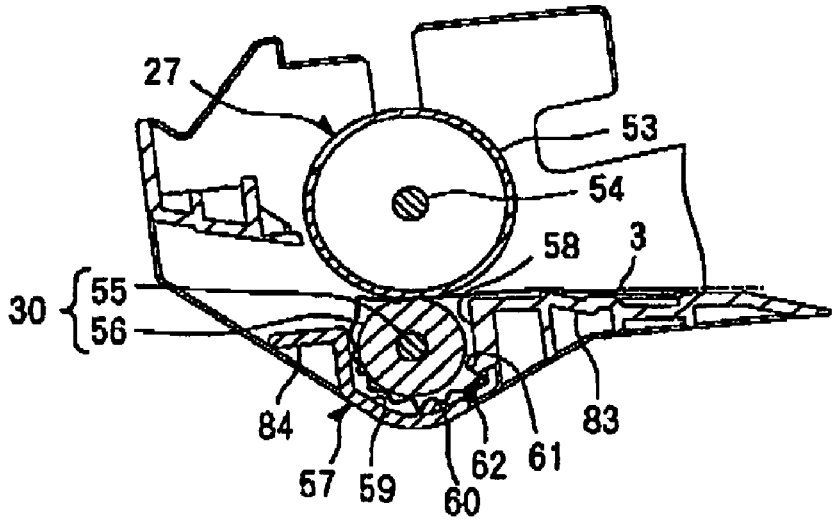

FIGS. 5A-5D illustrate how winding of the paper sheet 3 around the transfer roller 30 occurs in an arrangement where the retaining portions 62 are not provided. FIGS. 6A and 6B illustrate how the retaining portions 62 and the retention spaces prevent winding of the paper sheet around the transfer roller 30.

The winding of the paper sheet around the transfer roller 30 tends to occur particularly with a paper sheet which is limp and exhibits a relatively high electric resistance, such as a thin sheet of short grain paper, for instance. That is, a leading edge of a paper sheet 3 of such a type of paper closely adheres to the outer circumferential surface of the photoconductive drum 27 after its passage through the nip between the photoconductive drum 27 and the transfer roll 30, as shown in FIG. 5A. As the drum 27 rotates with the leading edge of the paper sheet 3 adhering to the outer circumferential surface of the photoconductive drum 27, the leading edge of the paper sheet 3 is lifted off the sheet feeding path.

As the drum 27 further rotates, an intermediate portion of the paper sheet 3 as has just passed the nip between the drum 27 and the transfer roller 30 adheres to the outer circumferential surface of the drum 27, while the leading edge of the paper sheet 3 lifts off the outer circumferential surface of the drum 27 to be brought into contact with the upper cover structure 71 of the housing structure 51 as is opposed to the drum 27, as shown in FIG. 5A. Then, when the photoconductive drum 27 further rotates with the paper sheet 3 prevented from further being lifted by its contact with the upper cover structure 71, the intermediate portion of the paper sheet 3 is further fed out to the downstream side of the nip between the drum 27 and transfer roller 30 in the sheet feeding direction, causing the paper sheet 3 to bend in the vicinity of the rear end of the lower cover structure 57, as shown in FIG. 5B. The thus caused bending in the paper sheet 3 progresses so that the bent portion enters between the transfer roller 30 and the rear end of the lower cover structure 57, as shown in FIG. 5C, and as the transfer roller 30 rotates, the paper sheet 3 is pulled into between the transfer roller 30 and the rear end of the lower cover structure 57 on and on.

The paper sheet 3 pulled into between the transfer roller 30 and the lower cover structure 57 proceeds along a surface of the lower cover structure 57 which is opposed to the transfer roller 30, and along the forward direction of the rotation of the transfer roller 30. When a leading edge of the paper sheet 3, from which the paper sheet 3 enters between the transfer roller 30 and lower cover structure 57, goes out through between the transfer roller 30 and a front end of the lower cover structure 57 after wound around the transfer roller 30 by one turn, as shown in FIG. 5D, the leading edge of the paper sheet 3 is brought into contact with an upper-stream side part of the paper sheet 3 on the upstream side of the nip between the photoconductive drum 27 and transfer roller 30 in the sheet feeding direction. The leading edge of the paper sheet 3 is then pulled into between the upstream side part of the paper sheet 3 and the transfer roller 30 at the nip, resulting in the winding of the paper sheet 3 around the transfer roller 30.

On the other hand, in the arrangement where the retaining portions 62, one of which is shown in FIG. 6A, are provided, the paper sheet 3 pulled in between the transfer roller 30 and lower cover structure 57 is brought into contact with the contact portions 61 at its leading edge during the paper sheet 3 proceeds between the transfer roller 30 and lower cover structure 57, and the state where the leading edge and the contact portions 61 are in contact is maintained. Thereafter, the paper sheet 3, whose leading edge is in contact with the contact portions 61 as the paper sheet 3 is fed by rotation of the transfer roller 30, is retained in the retention spaces in a bent or folded state, as shown in FIG. 6B, thereby causing a paper jam.

As has been described above, in the laser printer 1, the leading edge of the paper sheet 3 having entered between the transfer roller 30 and lower cover structure 57 is brought into contact with the contact portions 61, and then held in contact therewith. Consequently, the paper sheet 3 is retained in the retention spaces on the upstream side of the contact portions 61 in the direction of rotation of the transfer roller 30. Hence, before the leading edge of the paper sheet 3 has been turned around the transfer roller by one complete turn, the paper jam occurs at the retaining portions 62 or in the retention spaces, thereby preventing the paper sheet 3 from winding around the transfer roller 30. Further, the contact portions 61 are formed to be spaced from the outer circumferential surface of the transfer roller 30, damage of the transfer roller 30 by its contact with the contact portions 61 is prevented. That is, winding of the paper sheet 3 around the transfer roller 30 is reliably prevented without damaging the transfer roller 30.

The outer circumferential surface of the transfer roller 30 except a part thereof located at an upper position to be opposed to the photoconductive drum 27, is protected by the lower cover structure 57, preventing the transfer roller 30 from being damaged upon removing of the process cartridge 17 from the main body casing 2. The formation of the retaining portions 62 in this lower cover structure 57 simplifies the structure of the process cartridge 17.

The contact portions 61 do not contact the transfer roller 30 having the shaft 55 whose opposite ends are in contact with the bottoms of the support grooves 78 of the support plates 77 due to its own weight while the process cartridge 17 is removed from the main body casing 2 of the laser printer 1. Hence, the transfer roller 30 is not damaged by its contact with the contact portions 61.

Since the contact portions 61 are formed in the vertical part 58 of the lower cover structure 57 as a part of the opposed surface, it is easy to have the contact portions 61 spaced from the outer circumferential surface of the transfer roller 30, thereby simplifying the structure of the process cartridge 17.

Further, since the contact portions 61 are in the form of protrusions, the structure is further simplified.

Since the contact portions 61 are opposed to the connecting part 60 or vertical part 58, which constitutes a part of the opposed surface, via the retention spaces, so that each of the retaining portions 62 is formed in a claw-like shape in cross section, the leading edge of the paper sheet 3 proceeding along the connecting part 60 can be brought into contact with the contact portions 61 with reliability. Hence, the leading edge of the paper sheet 3 can be reliably held in contact with the contact portions 61, improving the reliability of preventing winding of the paper sheet 3 around the transfer roller 30. It is noted that although the leading edge of the paper sheet 3 can be held in contact with the contact portions 61 as least where the contact portions 61 are formed in the opposed surface, the reliability of holding the leading edge in contact with the contact portions 61 is further enhanced where each of the retaining portions 62 has the claw-like shape in cross section. That is, where each of the contact portions 61 simply protrudes from the vertical part 58 of the opposed surface and not downward such that an under surface of the contact portion 61 forms a right or obtuse angle with the vertical part 58, the paper sheet as once brought into contact with the contact portions 61 may be further fed upward, disengaged from the contact portions 61. However, where the each contact portion 61 protrudes downward as described above, the paper sheet is reliably retained in the retention space defined between the transfer roller 30 and the lower cover structure 57.

Since a plurality of the contact portions 61 are arranged along the axial direction of the transfer roller 30 at intervals, the winding of the paper sheet 3 around the transfer roller 30 can be reliably prevented irrespectively of the size of the paper sheet 3.

The laser printer 1 comprising the process cartridge 17 as described above is capable of forming an image on a recording medium smoothly and reliably.

In the present embodiment, a part of the vertical part 58, a part of the connecting part 60, and the contact portions 61 constitute the retaining portions 62 each having a claw-like shape in cross section. However, the contact portions 61 may be otherwise formed.

Figure 7:
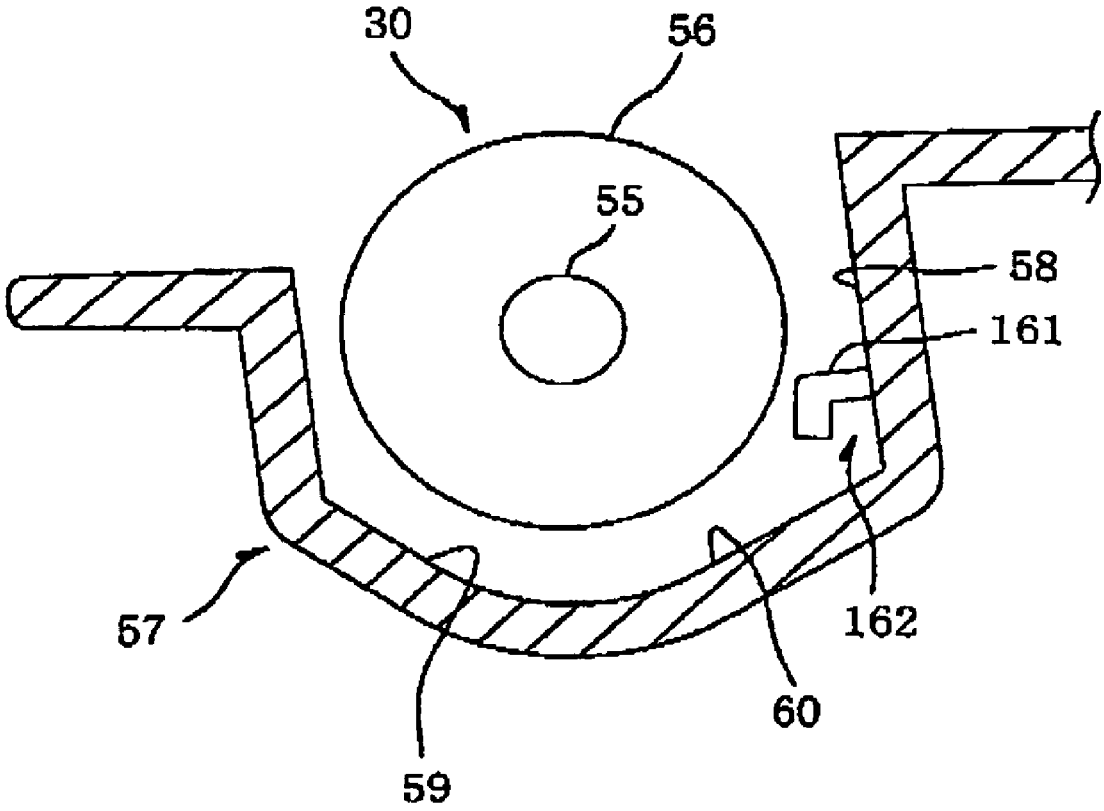
FIG. 7 is a side cross-sectional view of a relevant portion of a laser printer as an image forming apparatus according to a second embodiment of the invention, showing a contact portion which is formed in a claw-like shape in cross section.

FIG. 7 shows a relevant part of a laser printer according to a second embodiment of the invention, where each of a plurality of contact portions 161 is L-shaped in cross section and including a part opposed to the vertical part 58 via a retention space. In the following description of the second embodiment, parts or elements identical with those in the first embodiment will be denoted by the same reference numerals as used in the first embodiment.

Each contact portion 161, a part of a vertical part 58, and a part of a connecting part 60 constitute a retaining portion 162, inside which a retention space is defined. In the second embodiment, too, a leading edge of a paper sheet 3 entering between a transfer roller 30 and a lower cover structure 57 is brought into contact with the contact portions 161 and held in contact therewith, thereby retaining the paper sheet 3 at the retaining portions 162 or in the retention spaces with reliability.

Figure 8B:
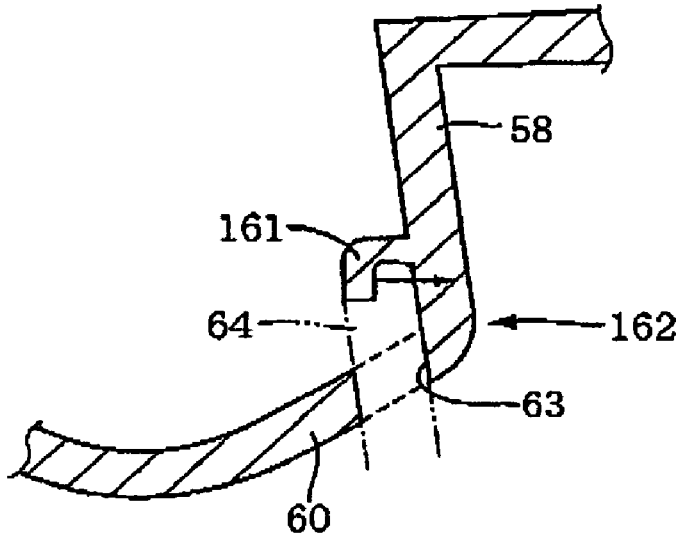
FIG. 8B is a cross-sectional view of a retaining portion and its vicinity, including an opening necessary for forming a contact portion, in the laser printer according to the second embodiment.

In the second embodiment, too, openings 63 are formed in the connecting part 60 of a lower cover structure 57, as shown in FIG. 8B, for facilitating formation of undercuts adjacent to the respective contact portions 161.

In each of the first and second embodiments, a plurality of the contact portions 61, 161 may be arranged along a direction of the rotation of the transfer roller 30 at intervals.

What is claimed is:

1. A process cartridge removably installed in an image forming apparatus, the process cartridge comprising:

an image carrier for carrying a developer image;

a transfer roller formed of an elastic material, and disposed adjacent to the image carrier to form a pressure nip therebetween such that the developer image on the image carrier is transferred onto a recording medium as being passed through the nip;

a winding preventer which is spaced from an outer circumferential surface of the transfer roller and prevents the recording medium from winding around the transfer roller; and a cover which covers at least a part of the outer circumferential surface of the transfer roller, and which has an opposed surface opposed to the outer circumferential surface of the transfer roller, wherein the winding preventer has a contact surface which extends from the opposed surface of the cover toward the outer circumferential surface of the transfer roller, such that a leading edge of the recording medium is brought into contact with the contact surface and is then held in contact with the contact surface when the recording medium is pulled into between the outer circumferential surface of the transfer roller and the opposed surface of the cover and is then moved in a medium movement direction corresponding to a rotational direction of the transfer roller, wherein the opposed surface of the cover includes an immediately upstream portion which is immediately upstream of the contact surface of the winding preventer as seen in the rotational direction of the transfer roller, and wherein an angle formed between at least a portion of the contact surface and the immediately upstream portion of the opposed surface is acute.

2. The process cartridge according to claim 1, wherein the winding preventer is incapable of moving relatively to the cover.

3. The process cartridge according to claim 1, further comprising a retention space configured to retain the recording medium whose leading edge is being held in contact with the contact surface, on the upstream side of the contact surface as seen in the rotation direction of the transfer roller.

4. The process cartridge according to claim 1, wherein the contact surface has an L-shaped cross section that is taken along the medium movement direction.

5. The process cartridge according to claim 1, wherein the winding preventer is formed integrally with the cover.

6. The process cartridge according to claim 5, wherein the winding preventer is formed by injecting a resin material into a mold, and the cover has an opening for pulling out a movable insert die there through after the molding, the insert die being used to form an undercut adjacent to the contact surface in the winding preventer.

7. The process cartridge according to claim 1, wherein the cover is disposed on the side of the transfer roller with respect to a sheet feeding path along which the recording medium is transported, in a direction in which the image carrier and the transfer roller are aligned, and formed such that one of opposite ends thereof is disposed on the upstream side of the nip in a direction parallel to the sheet feeding path while the other end of the cover is disposed on the downstream side of the nip, the cover being continuous from the one end to the other end to cover the outer circumferential surface of the transfer roller.

8. The process cartridge according to claim 7, wherein the opposed surface is a smoothly curved continuous surface extending from the other end of the cover to a position where the contact surface is formed.

9. The process cartridge according to claim 1, wherein the transfer roller is disposed below the image carrier, and the cover covers the transfer roller from the under side.

10. The process cartridge according to claim 9, wherein the transfer roller is held by the cover to be movable along a substantially vertical direction while the process cartridge is removed from the image forming apparatus, and wherein the winding preventer is disposed at a position not to contact the transfer roller while the process cartridge is removed from the image forming apparatus.

11. The process cartridge according to claim 1, wherein a plurality of the winding preventers are arranged at intervals along a rotation axis of the transfer roller.

12. The process cartridge according to claim 1, wherein the elastic material forming the transfer roller is an elastic foamed material.

13. An image forming apparatus for forming an image on a recording medium, the image forming apparatus comprising:

an elastic roller made of an elastic material;

a cover which covers at least a part of an outer circumferential surface of the elastic roller, and which has an opposed surface opposed to the outer circumferential surface of the elastic roller; and a winding preventer which is disposed on the cover such that the winding preventer is incapable of moving relatively to the cover and spaced from the outer circumferential surface of the elastic roller, so as to prevent the recording medium from winding around the elastic roller, wherein the winding preventer has a contact surface which extends from the opposed surface of the cover toward the outer circumferential surface of the elastic roller, such that a leading edge of the recording medium is brought into contact with the contact surface and is then held in contact with the contact surface when the recording medium is pulled into between the outer circumferential surface of the elastic roller and the oppose surface of the cover and is moved in a direction corresponding to a rotational direction to the elastic roller, wherein the opposed surface of the cover includes an immediately upstream portion which is immediately upstream of the contact surface of the winding preventer as seen in the rotational direction of the elastic roller, and wherein an angle formed between at least a portion of the contact surface and the immediately upstream portion of the opposed surface is acute.

14. The image forming apparatus according to claim 13, further comprising a retention space configured to retain the recording medium whose leading edge is being held in contact with the contact surface, on the upstream side of the contact surface as seen in the rotation direction of the elastic roller.

15. The image forming apparatus according to claim 14, further including an image carrier which carries a developer image, and wherein the elastic roller is a transfer roller which is formed of an elastic foamed material, the elastic roller being disposed adjacent to the image carrier to form a pressure nip therebetween so that the developer image on the image carrier is transferred onto the recording medium as being passed through the nip.

16. The image forming apparatus according to claim 15, wherein the cover is disposed on the side of the transfer roller with respect to a sheet feeding path, along which the recording medium is transported, in a direction in which the image carrier and the transfer roller are aligned, and formed such that one of opposite ends of the cover is disposed on the upstream side of the nip in a direction parallel to the sheet feeding path while the other end of the cover is disposed on the downstream side of the nip, the cover being continuous from the one end to the other end to cover the outer circumferential surface of the transfer roller, and wherein the opposed surface is a smoothly curved continuous surface extending from the other end of the cover to a position where the contact surface is formed.

17. A process cartridge removably installed in an image forming apparatus, the process cartridge comprising:

an image carrier for carrying a developer image;

a transfer roller formed of an elastic material, and disposed adjacent to the image carrier to form a pressure nip therebetween such that the developer image on the image carrier is transferred onto a recording medium as being passed through the nip;

a winding preventer which is spaced from an outer circumferential surface of the transfer roller and prevents the recording medium from winding around the transfer roller; and a cover which covers a least a part of the outer circumferential surface of the transfer roller, and which has an opposed surface opposed to the outer circumferential surface of the transfer roller, wherein the winding preventer has a contact surface which extends from the opposed surface of the cover toward the outer circumferential surface of the transfer roller, such that a leading edge of the recording medium is brought into contact with the contact surface and is then held in contact with the contact surface when the recording medium is pulled into between the outer circumferential surface of the transfer roller and the opposed surface of the cover and is then moved into a medium movement direction corresponding to a rotational direction of the transfer roller, and wherein the contact surface of the winding preventer, which extends from the opposed surface of the cover toward the outer circumferential surface of transfer roller, is bent in a direction opposite to the medium movement direction so as to have an L-shaped cross section taken along the medium movement direction.

* * * * *

UNITED STATES PATENT AND TRADEMARK OFFICE

CERTIFICATE OF CORRECTION

PATENT NO. : 7,292,814 B2
APPLICATION NO. : 11/137507
DATED : November 6, 2007
INVENTOR(S) : Hideaki Deguchi It is certified that error appears in the above-identified patent and that said Letters Patent is hereby corrected as shown below:

Title page, Assignee (73):

Please replace "Kabshiki" with --Kabushiki-- and "Nagoya-shi, Aicki-ken (JP)" with --Nagoya-shi, Aichi-ken (JP)--.

Signed and Sealed this

Thirtieth Day of September, 2008

JON W. DUDAS
*Director of the United States Patent and Trademark Office*